US006704980B1

(12) United States Patent
Yamamoto et al.

(10) Patent No.: US 6,704,980 B1
(45) Date of Patent: Mar. 16, 2004

(54) BEAM FOR WEAVING AND SIZING METHOD

(75) Inventors: Mitsuyuki Yamamoto, Kanazawa (JP); Hiroyuki Mizuki, Kanazawa (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/937,672

(22) PCT Filed: Mar. 30, 2000

(86) PCT No.: PCT/JP00/02038

§ 371 (c)(1),
(2), (4) Date: Sep. 28, 2001

(87) PCT Pub. No.: WO00/58537

PCT Pub. Date: Oct. 5, 2000

(30) Foreign Application Priority Data

Mar. 30, 1999 (JP) ..... 11-87938

(51) Int. Cl.[7] ..... B65H 71/00; C08G 63/46
(52) U.S. Cl. ..... 28/178; 242/45
(58) Field of Search ..... 28/178, 172.2, 28/179, 182, 183, 190; 264/210 F, 290 T; 242/45

(56) References Cited

U.S. PATENT DOCUMENTS 3,887,070 A * 6/1975 Tajiri et al. ..... 206/410
3,975,488 A 8/1976 Patterson
4,986,483 A * 1/1991 Ryu et al. ..... 242/413.9
6,555,220 B1 * 4/2003 Koyanagi et al. ..... 428/373

FOREIGN PATENT DOCUMENTS

| | | |
|---|---|---|
| GB | 807185 | 1/1959 |
| JP | 49-27613 | 3/1974 |
| JP | 50-111362 | 9/1975 |
| JP | 57-29621 | 2/1982 |
| JP | 63-59412 | 3/1988 |

* cited by examiner

*Primary Examiner*—John J. Calvert
*Assistant Examiner*—Robert H. Muromoto, Jr.
(74) *Attorney, Agent, or Firm*—Finnegan, Henderson, Farabow, Garrett & Dunner, L.L.P.

(57) ABSTRACT

To provide a method for sizing polytrimethylene terephthalate fiber yarns and a warp beam improved in mutual stickiness of the yarns and excellent in weavability, The sizing method according to the present invention is characterized in that the yarns are dried while controlling a stretch ratio S (%) between a squeeze roll and a drying cylinder in a range from −9 to −3% or from −1 to +4%. From the sized yarns thus obtained, a warp beam is formed at a winding tension in a range from 0.09 to 0.22 cN/dtex to have hardness in a range from 65 to 90 degrees.

4 Claims, 1 Drawing Sheet

BEAM FOR WEAVING AND SIZING METHOD

TECHNICAL FIELD

The present invention relates to a warp beam of polytrimethylene terephthalate fiber yarns, a sizing method and a beaming method (that is, a method for forming an warp beam) and, particularly, to a warp beam capable of restricting the mutual stickiness of sized yarns in the warp beam, excellent in weavability and capable of providing a woven fabric having a favorable warp-wise quality.

BACKGROUND ART

When a woven fabric is produced by using synthetic fiber yarns such as polyester or polyamide as warp yarns, the warp yarns are sized with a sizing agent through a sizing machine as shown in FIG. 1, and are woven by a water jet loom or an air jet loom.

In the sizing machine shown in FIG. 1, a plurality of raw yarns 9 mounted to a creel 1 are arranged at a pitch through a reed 2, and after being applied with a sizing agent while dipped in a bath 3 of a solution of the sizing agent, squeezed by squeezing rolls 4 to have a predetermined pickup of the sizing agent. Subsequently, the yarns 9 are dried through a first dry chamber 5, a second dry chamber 6 and dry cylinders 7, and taken up as a sizing beam 8.

A stretch ratio S (%) in the sizing process is represented by a ratio of a speed of the squeeze rolls 4 to that of the dry cylinders 7. That is, when the speed of the squeeze rolls 4 is 1.0 and the speed of the dry cylinders 7 is 0.97, S is −3%, while if that of the dry cylinder 7 varies to 1.03, S becomes +3%.

In the prior art, the stretch ratio S (%) of polyester yarns is generally adjusted to be within a range of −2%±0.5%; for example, when warp yarns of 56 dtex/24 f are sized, the stretch ratio S is selected to be approximately −2.4%. When textured yarns or others having somewhat different properties from the raw yarns, a composition and a pickup of the sizing agent and/or an amount of additives, such as a penetrant, to be added may be adjusted.

If polytrimethylene terephthalate fiber yarns are sized at the same stretch ratio S(%) as in the conventional yarns; i.e., approximately −2.4%, the yarns are excessively stretched in the dry zone of the sizing machine, resulting in problems in that yarn breakage may occur due to the wrapping of yarns or single-filaments around rollers in the sizing machine and a winding hardness of an warp beam becomes abnormally high and gradually harder with time, which in turn generates the mutual stickiness of the sized yarns to disturb the shedding motion. Thus, it was found that the deterioration of warp-wise quality such as tight warp or slack warp occurs to disable the weaving operation.

To solve the above problems, the inventors tried to reduce the pickup of sizing agent to a level lower than that usually adopted, but the mutual stickiness could not be dissolved and weavability became worse. Moreover, the inventors tried to use some sizing agents which have so lower viscosity as to hardly generate the mutual stickiness, but the mutual stickiness of warp yarns was not satisfactorily improved.

DISCLOSURE OF THE INVENTION.

The present inventors fundamentally reconsidered the sizing and beaming conditions of polytrimethylene terephthalate fiber yarns based on the novel idea of sizing technique unexpected from the prior art, and attained the present invention.

That is, the present invention is as follows:

1. A warp beam formed of a plurality of sized polytrimethylene terephthalate fiber yarns wound in a sheet form, characterized in that the hardness of the warp beam is in a range from 65 to 90 degrees.
2. A warp beam as defined by claim 1, characterized in that the warp beam is formed of polytrimethylene terephthalate fiber yarns sized so that a characteristic value Q×R satisfies the following equation:

$$1200 \leqq Q \times R \leqq 1800$$

wherein Q is an initial Young's modulus (represented by cN/dtex) and R is a stretch recovery (%) at 10% elongation of the sized yarn.

3. A method for sizing polytrimethylene terephthalate fiber yarns characterized in that the yarns are fed from squeeze rolls to dry cylinders, during which a stretch-ratio S (%) is controlled between the squeeze rolls and the dry cylinders at a value in a range from −9 to −3% or from −1 to +4%.
4. A beaming method characterized in that sized yarns wound on a sizing beam obtained by the sizing method defined by claim 3 are wound on a warp beam with a tension in arrange from 0.09 to 0.22 cN/dtex.

The present invention will be described in more detail below.

In the present invention, polytrimethylene terephthalate fiber is a polyester fiber containing trimethylene terephthalate as a main repeated unit wherein the trimethylene terephthalate unit is contained at a ratio of approximately 50 mol % or more, preferably 70 mol % or more, more preferably 80 mol % or more, further more preferably 90 mol % or more. Accordingly, this fiber includes polytrimethylene terephthalate containing, as a third component, another acidic component and/or glycolic component of a total amount of less than approximately 50 mol %, preferably less than 30 mol %, more preferably less than 20 mol %, further more preferably less than 10 mol %.

The polytrimethylene terephthalate is synthesized by polymerizing terephthalic acid or a functional derivative thereof with trimethylene glycol or a functional derivative thereof in the presence of catalyst under a suitable reactive condition. In this synthesis process, one kind or more of third component may be added to the copolymerized polyester. Also, a polyester other than polytrimethylene terephthalate, such as polyethylene-terephthalate, or a polyamide may be blended with the polytrimethylene terephthalate or spun together to be a composite fiber (a sheath-core type fiber or a side-by-side type fiber).

The third component to be added includes aliphatic dicarbonic acid (oxalic acid, adipic acid or the like), cycloaliphatic dicarbdnic acid (cyclohexane dicarbonic acid or the like), aromatic dicarbonic acid (isophthalic acid, sodium sulfoisophthalic acid or the like), aliphatic glycol, (ethylene glycol, 1,2-propylene glycol, tetramethylene glycol, or the like), cycloaliphatic glycol (cyclohexane dimethanol or the like), aliphatic glycol containing aromatic group (1,4-bis(β-hydoxyethoxy) benzene or the like), polyether glycol (polyethylene glycol, polypropylene glycol or the like), aliphatic oxycarbonic acid (ω-oxycapronic acid or the like) or aromatic oxycarbonic acid (p-oxybenzoic acid or the like). Also, compounds having one or three or more ester-forming functional groups (benzoic acid, glycerin or the like) may be used provided the polymer is maintained substantially in a linear range.

The polytrimethylene terephthalate may be added with a delustering agent such as titanium dioxide, a stabilizing agent such as phosphoric acid, an ultraviolet absorbing agent such as derivative of hydroxybenzophenone, a crystallizing nucleus such as talc, a lubricant such as aerozil, an antioxidant such as derivative of hindered phenol, a flame retardant, an antistatic agent, a pigment, a fluorescent whitener, an infrared absorbing agent, and an antifoaming agent.

The polytrimethylene terephthalate fiber used in the present invention may be spun by either a normal method wherein after an undrawn yarn has been obtained at a takeup speed of approximately 1500 m/min, it is drawn at a draw ratio in a range from approximately 2 to 3.5 times, a spin-draw method wherein a spinning process is directly combined with a drawing process, or a spin-takeup method wherein a yarn spun from a spinning machine is directly taken up at a high speed of 5000 m/min or more.

The configuration of the fiber may be either uniform or irregular in thickness in the lengthwise direction, and a cross-sectional shape thereof may be circular, triangular, an L-shape, a T-shape, a Y-shape, a W-shape, an eight-lobal shape, a flat shape and a dog-bone shape. Also, the fiber may be hollow or even an indefinite shape.

According to the present invention, the polytrimethylene terephthalate fiber yarn may include those composed of at least 50%, preferably 70 to 100% of polytrimethylene terephthalate multifilamentary fibers, and less than 50% of other fibers.

The other fibers to be mixed with polytrimethylene terephthalate fibers include synthetic fiber such as polyethylene terephthalate fiber, polybutylene terephthalate fiber, polyamide fiber, polyacrylic fiber, polyolefin fiber or acetate fiber, artificial fiber such as cuprammonium rayon or viscose rayon and silk multifilamentary fiber. They may be mixed through a known means such as a texturing process including a false-twisting method or a fluid-jet method. Also, they may be a high-shrinkage yarn, a low-shrinkagd yarn or a high-speed spun yarn (obtained by a spin-draw takeup method or a spin takeup method), which may be entangled, mixed (for example, as a so-called different-shrinkage mixed yarn of the high-shrinkage yarn and the low-shrinkage yarn) or twisted together.

According to the present invention, the warp beam is a beam on which a number of warp yarns (for example, 4000 to 8000 ends) capable of being woven on a loom are collected in a sheet form, which is usually formed by winding sized yarns supplied from several or over ten beams (such a beam is referred to as a sizing beam) on which sized yarns are wound in parallel in a sheet form on a single beam through a beaming machine.

The warp beam according to the present invention has a winding hardness in a range from 65 to 90 degrees, preferably from 65 to 85 degrees, more preferably from 70 to 80 degrees. If the winding hardness of the warp beam is less than 65 degrees, a beam gap (a gap created between a flange of the warp beam and a pile of the sized yarns) may occur to disturb the smooth release of yarns. Contrarily, if the hardness exceeds 90 degrees, a mutual stickiness between the sized yarns is liable to generate.

The phenomenon in which the sized yarns stick mutually to disable the-weaving operation in the warp beam formed by winding polytrimethylene terephthalate fiber yarns in a sheet form is surmised to be related to a tightening force of the sized yarn wound in the warp beam. Accordingly, when the winding hardness is within the above-mentioned range, the tightening force is suppressed to a minimum level to prevent the mutual stickiness in the sizing beam from occurring to result in the stable weavability and a woven fabric excellent in warp-wise quality.

The warp beam according to the present invention is perferably formed of polytrimethylene terephthalate fiber yarns sized to satisfy the following equation:

$$1200 \leqq Q \times R \leqq 1800$$

wherein Q is an initial Young's modulus (cN/dtex) of the. sized yarn and R is a stretch recovery (%) at 10% elongation of the sized yarn.

A change in winding hardness with time is defined by the difference between hardness values one and two weeks after. It was found that the change in winding hardness with time of the warp beam of polytrimethylene terephthalate fiber yarns is related both to an initial Young's modulus Q of the sized yarn and a stretch recovery R (%) at 10% elongation, and can be significantly suppressed, together with the mutual stickiness if a product of the both is controlled to be within the range defined by the above-mentioned equation. Such knowledge could not have been expected, at all, from the conventional polyethylene terephthalate fiber but was initially found by the present inventors.

If the characteristic value Q×R is less than 1200, a so-called beam gap is liable to be generated, which is a gap between a flange of the warp beam and a pile of the sized yarns. Contrarily, if it exceeds 1800, the change in winding hardness with time of the warp beam increases to exceed 90 degrees. Thus, the preferable range of Q×R is in a range from 1400 to 1700.

A sizing method according to the present invention is unique as described below, solely from which a warp beam of the present invention is obtainable.

The sizing method according to the present invention is a method for sizing polytrimethylene terephthalate fiber yarns characterized in that the yarns are fed from squeeze rolls to dry cylinders, during which a stretch ratio S (%) is controlled between the squeeze rolls and the dry cylinders at a value in a range from −9 to −3% or from −1 to +4%.

The present inventors have studied various methods for sizing polytrimethylene terephthalate fiber yarns, and found that satisfactory sized yarns are never obtainable even if a recipe of sizing agent is variously changed under the conventional sizing conditions used for polyethylene terephthalate fiber yarns; that is, the value S is within a range of −2±0.5%.

The present inventors tried to adapt a gearing part of a sizing machine to be capable of largely changing the stretch ratio (the value S) by using customized gears, and studied methods for sizing polytrimethylene terephthalate fiber yarns obtained from different spinning processes. As a result, it was surprisingly found that a range of the value S for polytrimethylene terephthalate fiber is far from that for polyethylene terephthalate fiber, and a warp beam having a winding hardness in a range from 65 to 90 degrees is obtainable by changing the sizing condition to two ranges of the value S in accordance with the spinning processes. In polytrimethylene terephthalate fiber resulted from a conventional two-stage process of spinning and drawing, the value S is on an over-feed side; that is, in a range from −9% to −3%. While, in that obtained from a spin-draw process, the value S is in a range from −1% to +4%.

A reason is not apparent why the ranges of value S are different from each other in accordance with the production processes of raw yarns as described above. However, a raw yarn produced by a two-stage process of spinning and drawing disclosed in Japanese Patent Application No. 10-293477 and a raw yarn produced by a spin-draw method disclosed in WO 99/27168 are different both in the maximum stress generated when the raw yarn is heated (a peak value of thermal stress) and in the peak temperature thereof. That is, in the former case, there is a tendency in that the peak value of thermal stress is high and the peak temperature is low, while in the latter case, there is a tendency in that the peak value of thermal stress is low and the peak temperature is high. Thus, it is surmised that such a difference in thermal stress characteristics is related to the difference in a range of value S.

In this regard, while the peak value of thermal stress and the peak temperature of the conventional polyethylene terephthalate fiber is approximately equal to those of the polytrimethylene terephthalate fiber obtained from the above-mentioned two-stage process of spinning and drawing, the range of value S of the former is −2±0.5% which is far different from the above-mentioned range.

A reason is not apparent why the ranges of value S are far different, from each other, between the raw polytrimethylene terephthalate fiber obtained from the two-stage process of spinning and drawing and the polyethylene terephthalate fiber although the peak value of thermal stress and the peak temperature thereof are respectively approximately equal in both the fibers. However, it is surmised that some of the structural factors caused by a molecular structure and/or a crystal or non-crystal structure of polytrimethylene terephthalate fiber itself is singularly actuated and extraordinarily amplified by heat during the sizing.

That is, according to the sizing method of the present invention, in a case of the raw yarn obtained by a two-stage process of spinning and drawing, S is in a range from −9 to −3%, preferably from −8.1 to −4.2%. If the overfeed exceeds −9%, the running state of the yarns in the dry zone of the sizing machine becomes unstable to cause troubles such as yarn breakage. On the other hand, if the overfeed is less than −3%, the yarns are dried at an excessive tension, whereby the warp beam is tightly wound in the subsequent process to cause the mutual stickiness in the warp beam. In a case of the raw yarn obtained by a spin-draw method, S is in a range from −1 to +4%, preferably from 0 to +3%. If S is less than −1%, the running state of the yarns becomes unstable, while if it exceeds +4%, the yarns are dried at an excessive tension to cause mutual stickiness in the warp beam.

According to the present invention, when the yarn sheets of the sized polytrimethylene terephthalate fiber yarns drawn out from a plurality of sizing beams are superposed with each other to form the warp beam in the beaming process, a tension of the sized yarn to be wound on the warp beam (this tension is also referred to as a sheet tension) is in a range from 0.09 to 0.22 cN/dtex, preferably from 0.11 to 0.2 cN/dtex. If the sheet tension is less than 0.09 cN/dtex, the sheet tension becomes unstable to cause a cutting-in phenomenon of the yarn into the yarn layers wound on the warp beam. Contrarily, if it exceeds 0.22 CN/dtex, the mutual stickiness phenomenon is liable to occur in the warp beam.

The sizing process referred to in the present invention is a process for impregnating the fiber yarn with a sizing agent solution and then drying the yarn to solidify the same. Generally, this process may include a method in which fiber yarns are directly drawn out from a creel to a sizing machine and sized thereby and a method in which fiber yarns are once wound on an intermediate beam which is then sized.

A preferable range of the sizing condition according to the present invention is that a drying temperature in the chamber is in a range from 100 to 135° C., a drying temperature in the cylinder is in a range from 80 to 110° C., and a sizing tension (a yarn tension between the second dry chamber and the dry cylinder) is in a range from 0.10 to 0.30 cN/dtex. If the drying temperature in the chamber exceeds 135° C., a thermal-stress in the yarn disappears, whereby the final fabric may be inferior in hand while if lower than 100° C., the drying may become insufficient. Similarly, if the drying temperature in the cylinder exceeds 110° C., a thermal stress in the yarn disappears, whereby the final fabric may be inferior in hand, while if it is lower than 80° C., the drying may become insufficient. If the sizing tension is less than 0.10 cN/dtex, the yarn running state may become unstable to cause the yarn breakage, while if it exceeds 0.30 cN/dtex, the mutual stickiness between yarns may occur in the warp beam.

In the present invention, a preferable sizing agent includes acrylic ester type copolymeric ammonium salt, acrylic ester type copolymeric soda salt, polyvinyl alcohol or others. For a water jet loom (hereinafter referred to as WJL), acrylic ester type copolymeric ammonium salt is preferably used, while for an air jet loom (hereinafter referred to as AJL), a mixture of polyvinyl alcohol and acrylic ester type copolymeric soda salt is preferably used.

The above-mentioned sizing agent solution is preferably added with releasable oil in a range from 5 to 20% by weight relative to a pure content of the sizing agent. If the oil is less than 5% by weight, it is difficult to prevent the mutual stickiness from occurring, while if it exceeds 20% by weight, the adhesivity of the sizing agent lowers. Examples of the releasable oil are a paraffin type wax, a silicone type wax and a natural wax such as carnauba wax.

More preferably, for the purpose of facilitating the replacement of a yarn oil with a sizing agent to increase the adhesivity of the sizing agent, a penetrant in a range from 0.001 to 0.5% by weight may be added to a sizing agent solution. Such a penetrant includes isopropyl alcohol, paraxylene, fluorine type penetrant or others. If the amount of the penetrant is less than 0.001% by weight, the replacement effect is too small, while if it exceeds 0.5% by weight, there is a risk of environmental contamination due to the volatilization of the component. Also, the sizing agent may be added with an antistatic agent, a lubricant oil or others.

A concentration of the sizing agent is preferably from 6 to 20% by weight, more preferably from 7 to 15% by weight. If the concentration is lower than 6% by weight, a pickup of the sizing agent becomes less than 3% by weight to result in an insufficient fiber-collective force, while if it exceeds 20% by weight, the viscosity of the sizing agent solution becomes excessively high to cause the irregular adhesion of the sizing agent or generate a yarn lap-up to rollers or rods.

In the sizing agent for a WJL, a pickup of the sizing agent is preferably in a range from 3 to 12% by weight, more preferably from 5 to 10% by weight. If the pickup is less than 3% by weight, the fiber-collective force of the sized yarn becomes insufficient, while if it exceeds 12% by weight, the mutual stickiness is liable to occur.

In the sizing agent for an AJL, a pickup of the sizing agent is preferably in a range from 8 to 17% by weight, more preferably from 10 to 15% by weight. If the pickup is less than 8% by weight, the fiber-collective force of the sized yarn becomes insufficient, while if it exceeds 17% by weight, the mutual stickiness is liable to occur.

BEST MODES FOR CARRYING OUT THE INVENTION

Figure 1:
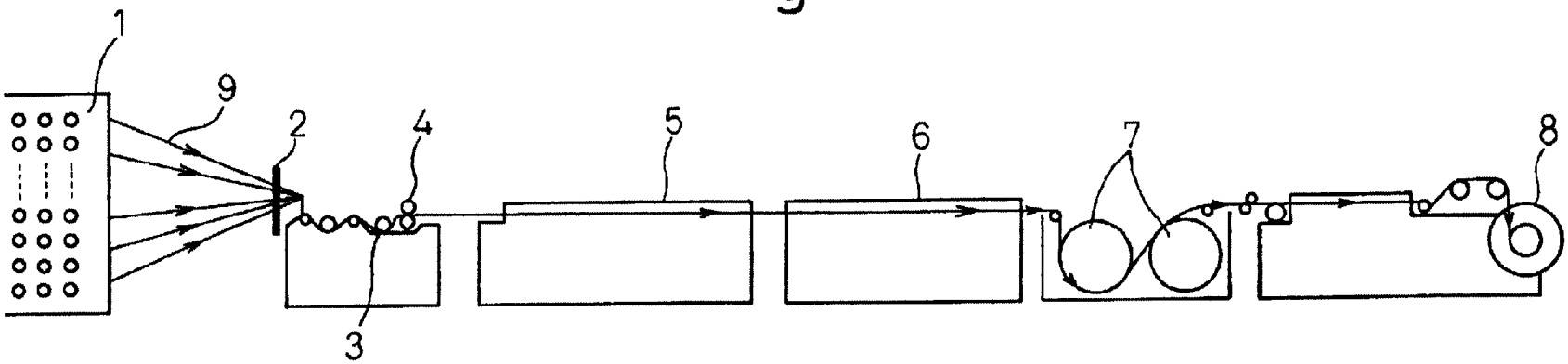
FIG. 1 is a schematic view of an example of a sizing machine for synthetic fiber yarns.

The present invention will be described in more detail below with reference to the preferred embodiments. It should be noted, however, that the present invention is not limited thereto.

The measurement and the estimation were carried out as follows:

(1) ηsp/c

Polymer was dissolved at 90° C. in o-chlorophenol to be a concentration of 1 g/dL, and the resultant solution is transferred to an Ostwald viscometer and measured at 35° C., from which ηsp/c was calculated by the following equation, $$\eta sp/c=[(T/T0)-1]/C$$

wherein T is a dropping time (seconds) of a sample solution, T0 is a dropping time (seconds) of a solvent, and C is a concentration of the solution (g/dL).

(2) Stretch Recovery at 10% Elongation

A yarn was set on a tensile tester at a chuck distance of 10 cm, and a stress-strain curve was depicted by stretching the yarn to 10% relative to the original length at a stretch speed of 20 cm/min and then contracting the yarn at the same speed. A point was determined on the stress-strain curve, at which the stress lowers to an initial load of 0.0088 cN/dtex, and a residual elongation L of this point was read, from which a stretch recovery at 10% elongation was calculated by the following equation, $$\text{Stretch recovery at 10\% elongation}=[(10-L)/10]\times 100(\%)$$

(3) Shrinkage in Boiling Water

Shrinkage in boiling water was measured as hank shrinkage in accordance with JIS-L-1013.

(4) Strength, Elongation and Initial Young's Modulus

A constant speed elongation type tensile tester RTM-100 manufactured by Toyo-Baldwin K. K. was used for obtaining a strength, an elongation and an initial Young's modulus at a chuck distance of 20 cm and a stretching speed of 20 cm/min in accordance with JIS-L-1013.

(5) Peak Value of Thermal Stress and Peak Temperature

A thermal stress tester. (for example, KE-2 type available from Kanebo Engineering K.K.) was used for measuring a peak value of stress under heat and a peak temperature. A loop was formed by tying opposite ends of a yarn of 20 cm long and set on the tester. A thermal stress curve was depicted under the condition of an initial load of 0.05 cN/dtex and a temperature rising speed of 100° C. /min. A peak value was read on the thermal stress, curve, which stress is the peak value of thermal stress and which temperature is the peak temperature.

(6) Yarn Running Stability During the Sizing

A yarn running stability during the sizing was determined based on the following criteria:

○- - - Yarn vibration was hardly seen

Δ- - - Yarn vibration was slightly observed

X - - - Yarn breakage and fluff generated, and yarn vibration was significant.

(7) Mutual Stickiness of Sized Yarns

Yarn releasability of a warp beam was estimated by a sensory test based on the following criteria:

◎- - - Yarns were very smoothly released

○- - - Yarns were easily released

Δ- - - Yarns were slightly difficult to be released

X - - - Yarns were releasable but difficult to be separated from each other

(8) Hardness of Warp Beam

Hardness was measured at,ten points on a surface of a warp beam seven and fourteen days after being formed by a hardness tester Type C (available from Kobunshi Keiki K.K.) and represented as an average value of the ten data.

(9) Warp-wise Quality of Woven Fabric

Estimation was made based on the following criteria:

◎- - - Tight warp or slack warp was not seen

○- - - Tight warpor slack warp was slightly seen

X - - - Tight warp or slack warp was frequently seen

Polytrimethylene terephthalate fiber used was produced in accordance with the following processes 1 and 2:

Process 1 (Two-stage Process of Spinning and Drawing)

As a warp yarn, polytrimethylene terephthalate having ηsp/c of 0.8 was melt-spun at a spinning temperature of 265°

C. and a spinning speed of 1600 m/min through a nozzle having 24 circular orifices to result in an undrawn yarn which was then drawn 2.3 times at a drawing speed of 800 m/min, a hot roll temperature of 60° C. and a hot plate temperature of 140° C. to result in a drawn yarn of 56 dtex/24 f. Physical properties of the drawn yarn are such that a strength is 3.6 cN/dtex, an elongation is 38%, a shrinkage in boiling water is 13%, an initial Young's strength of 26 cN/dtex, a peak value of thermal stress of 0.30 cN/dtex, a peak temperature of 160° C. and a stretch recovery at 10% elongation is 100%.

As a weft yarn, an undrawn yarn was obtained in the same manner as above except that a nozzle having 36 orifices was used, and then drawn 2.3 times to result in a drawn yarn of 84 dtex/36 f. Physical properties of the drawn yarn are such that a strength is 3.7 cN/dtex, an elongation is 39%, a shrinkage in boiling water is 13%, a peak value of thermal stress of 0.30 cN/dtex, a peak temperature of 160° C., an initial Young's strength of 25 cN/dtex and a stretch recovery at 10% elongation is 100%.

Process 2 (Spin-draw Method)

As a warp yarn, polytrimethylene terephthalate having ηsp/c of 0.8 was melt-spun by a direct spinning method through a nozzle having 24 circular orifices at a spinning temperature of 265° C., a first godet roller speed of 1200 m/min, a first godet roller temperature of 55° C., a second godet roller speed of 3390 m/min and a second godet roller temperature of 120° C. to result in a drawn yarn of 56 dtex/24 f. Physical properties of the drawn yarn are such that a strength is 3.2 cN/dtex, an elongation is 50%, a shrinkage in boiling water is 6.4%, an initial Young's strength of 22 cN/dtex, a peak value of thermal stress of 0.11 cN/dtex, a peak temperature of 180° C. and a stretch recovery at 10% elongation is 84%.

As a weft yarn, a drawn yarn of 84 dtex/36 f was obtained in the same manner as above except that a nozzle having 36 orifices was used. Physical properties of the drawn yarn are such that a strength is 3.2 cN/dtex, an elongation is 49%, a shrinkage in boiling water is 7.2%, an initial Young's strength of 21 cN/dtex, a peak value of thermal stress of 0.11 cN/dtex, a peak temperature of 180° C. and a stretch recovery at 10% elongation is 83.5%.

EXAMPLES 1 TO 8 AND COMPARATIVE EXAMPLES 1 TO 4

The polytrimethylene terephthalate yarn of 56 dtex/24 f obtained from the process 1 (two-stage process of spinning and drawing) was used as a warp yarn and the yarn of 84 dtex/36 f obtained from the same process was used as weft yarn. The sizing, beaming and weaving operations were carried out under the following conditions (a) and (b) suited for a WJL.

Results thereof were shown in Table 1.

TABLE 1

| No | S (%) | ST (cN/dtex) | BT (cN/dtex) | Q (cN/dtex) | R (%) | Q × R (% cN/dtex) | running stability | mutual stickiness | hardness of beam: after one week | hardness of beam: after two weeks | quality of warp | machine stop: during weaving (frequency/machine × day) |
|---|---|---|---|---|---|---|---|---|---|---|---|---|
| Comparative example 1 | −9.6 | impossible to measure | — | — | — | — | × | — | — | — | — | — |
| Example 1 | −9.0 | 0.09 | 0.18 | 15.5 | 86.8 | 1354 | Δ | ◎ | 65 | 66 | ○ | 0.5 |
| Example 2 | −8.1 | 0.12 | 0.18 | 16.5 | 89.4 | 1475 | Δ | ◎ | 70 | 71 | ○ | 0.3 |
| Example 3 | −6.0 | 0.17 | 0.18 | 16.8 | 92.6 | 1556 | ○ | ◎ | 75 | 77 | ○ | 0.1 |
| Example 4 | −4.2 | 0.23 | 0.18 | 17.2 | 94.0 | 1617 | ○ | ○ | 80 | 83 | ○ | 0.3 |
| Example 5 | −3.0 | 0.27 | 0.18 | 17.6 | 95.7 | 1684 | ○ | ○ | 85 | 88 | ○ | 0.6 |
| Comparative example 2 | −2.4 | 0.33 | 0.18 | 18.7 | 97.2 | 1820 | × | × | 92 | 98 | × | 5.0 |
| Comparative example 3 | −9.0 | 0.09 | 0.07 | 14.1 | 82.3 | 1160 | Δ | ◎ | 60 | 60 | — | — (beam gap) |
| Example 6 | −9.0 | 0.09 | 0.09 | 14.9 | 85.1 | 1268 | Δ | ◎ | 65 | 65 | ○ | 0.5 |
| Example 7 | −9.0 | 0.09 | 0.25 | 17.2 | 95.3 | 1639 | Δ | Δ | 86 | 90 | Δ | 0.5 |
| Example 8 | −3.0 | 0.27 | 0.21 | 18.0 | 96.0 | 1728 | ○ | Δ | 86 | 90 | Δ | 0.8 |
| Comparative example 4 | −3.0 | 0.27 | 0.23 | 19.1 | 97.2 | 1857 | ○ | × | 93 | 99 | × | 2.5 |

Note:
ST: sizing tension
BT: winding tension for forming warp beam (a) Sizing Conditions for a WJL (Water Jet Loom)

Sizer: warping sizer

Number of creels: 7:48

Sizing agent: acrylate ester type copolymeric ammonium salt of 9.5% by weight (pure weight base), anionic type antistatic agent of 0.2% by weight (apparent weight base), wax type oil of 4% by weight (apparent weight base) and 10.5% by weight (pure weight base relative to the sizing agent component)

After-oil: SP-8 (manufactured by Matsumoto Yushi K.K.) - - - 1 rpm

Drying temperature:
Chamber - - - 125° C./125° C.
Cylinder - - - 95° C./95° C.

Sizing speed: 100 m/min

Pickup of sizing agent: 6.5% by weight

Sizing length: 1000 m×7 beams (b) Beaming and Weaving Conditions for a WJL

Number of warp yarns: 5236 ends (corresponding to seven sizing beams)

Beaming speed: 100 m/min

Loom: ZW-303 WJL (manufactured by Tsudakoma K.K.)

Reed drawing-in width: 140cm

Weave: plain weave

Number of picks: 80 ends/2.54 cm

Warp tension: 0.13 cN/dtex

Rotational speed of loom: 600 rpm

EXAMPLES 9 TO 17 AND COMPARATIVE EXAMPLES 5 TO 8

The polytrimethylene terephthalate yarn of 56 dtex/24 f obtained-from the process 2 (spin draw-method) was used as a warp yarn and the yarn of 84 dtex/36 f obtained from the same process was used as a weft yarn. The sizing, beaming and weaving operations were carried out under the same conditions for a WJL as in Example 1.

Results thereof were shown in Table 2.

TABLE 2

| No | S (%) | ST (cN/dtex) | BT (cN/dtex) | Q (cN/dtex) | R (%) | Q × R (% cN/dtex) | running stability | mutual stickiness | hardness of beam after one week | hardness of beam after two weeks | quality of warp | machine stop during weaving (frequency/machine × day) |
|---|---|---|---|---|---|---|---|---|---|---|---|---|
| Comparative example 5 | −1.2 | impossible to measure | — | — | — | — | × | — | — | — | — | — |
| Example 9 | −0.9 | 0.09 | 0.18 | 15.8 | 91.8 | 1450 | Δ | ◎ | 65 | 65 | ○ | 0.6 |
| Example 10 | −0.6 | 0.13 | 0.18 | 16.3 | 92.0 | 1500 | ○ | ◎ | 70 | 71 | ○ | 0.5 |
| Example 11 | 0.6 | 0.16 | 0.18 | 16.6 | 93.7 | 1555 | ○ | ◎ | 73 | 75 | ○ | 0.3 |
| Example 12 | 1.5 | 0.18 | 0.18 | 16.8 | 94.5 | 1588 | ○ | ◎ | 78 | 80 | ○ | 0.1 |
| Example 13 | 2.7 | 0.21 | 0.18 | 17.1 | 95.3 | 1630 | ○ | ○ | 82 | 85 | ○ | 0.1 |
| Example 14 | 3.9 | 0.25 | 0.18 | 17.3 | 96.3 | 1666 | ○ | Δ | 84 | 88 | ○ | 0.3 |
| Comparative example 6 | 4.2 | 0.31 | 0.18 | — | — | — | × | × | 92 | 98 | × | — |
| Comparative example 7 | −0.9 | 0.09 | 0.07 | 14.0 | 83.9 | 1175 | Δ | ◎ | 60 | 60 | — | — (beam gap) |
| Example 15 | −0.9 | 0.09 | 0.09 | 14.2 | 87.3 | 1240 | Δ | ◎ | 65 | 65 | ○ | 0.5 |
| Example 16 | −0.9 | 0.09 | 0.25 | 18.1 | 95.5 | 1729 | Δ | Δ | 85 | 90 | Δ | 0.4 |
| Example 17 | 3.9 | 0.25 | 0.21 | 18.4 | 95.7 | 1760 | ○ | Δ | 85 | 89 | Δ | 0.8 |
| Comparative example 8 | 3.9 | 0.25 | 0.23 | 19.5 | 96.4 | 1880 | ○ | × | 92 | 99 | × | 6.0 |

Note:
ST: sizing tension
BT: winding tension for forming warp beam

EXAMPLE 18

The polytrimethylene terephthalate yarn of 56 dtex/24 f obtained from the process 1 (two-stage process of spinning and drawing) was used as a warp yarn and the yarn of 84 dtex/36 f obtained from the same process was used as a weft yarn. The sizing, beaming and weaving operations were carried out under the same conditions for a WJL as in Example 1, except that an amount of the wax type oil was reduced to 1% by weight (apparent weight base) and to 2.6% by weight on the pure weight base relative to the sizing agent component.

Results thereof were shown in Table 3.

TABLE 3

| No | S (%) | ST (cN/dtex) | BT (cN/dtex) | Q (cN/dtex) | R (%) | Q × R (% cN/dtex) | running stability | mutual stickiness | hardness of beam after one week | hardness of beam after two weeks | quality of warp | machine stop during weaving (frequency/machine × day) |
|---|---|---|---|---|---|---|---|---|---|---|---|---|
| Example 18 | −6.0 | 0.17 | 0.18 | 16.9 | 92.9 | 1570 | ○ | Δ | 85 | 90 | Δ | 1.0 |

Note:

ST: sizing tension

BT: winding tension for forming warp beam

EXAMPLES 19 TO 23 AND COMPARATIVE EXAMPLES 9 AND 10

The polytrimethylene terephthalate yarn of 56 dtex/24 f obtained from the process 1 (two-stage process of spinning and drawing) was used as a warp yarn, and the textured yarn made by false twisting the yarn of 84 dtex/36 f obtained from process 1 was used as a weft yarn. The sizing, beaming and weaving operations were, carried out under the following conditions (c) and (d) suited for a AJL.

Results thereof were shown in Table 4.

Drying temperature:
chamber - - - 125° C./130° C.
cylinder - - - 100° C./100° C.
Sizing speed: 60 m/min
Pickup of sizing agent: 12.2% by weight
Sizing length: 1000 m×11 beams
(d) Beaming and Weaving Conditions for an AJL
Number of warp yarns: 12474 ends (corresponding to eleven sizing beams)
Beaming speed: 100 m/min
Loom: ZA 209I AJL (manufactured by Tsudakoma K.K.)
Reed drawing in width: 227 cm
Weave: 2/2 weft rib weave

TABLE 4

| No | S (%) | ST (cN/dtex) | BT (cN/dtex) | Q (cN/dtex) | R (%) | Q × R (% cN/dtex) | running stability | mutual stickiness | hardness of beam after one week | hardness of beam after two weeks | quality of warp | machine stop during weaving (frequency/machine × day) |
|---|---|---|---|---|---|---|---|---|---|---|---|---|
| Comparative example 9 | −9.6 | impossible to measure | — | — | — | — | × | — | — | — | — | — |
| Example 19 | −9.0 | 0.09 | 0.13 | 15.0 | 86.2 | 1239 | Δ | ◎ | 65 | 65 | ○ | 0.8 |
| Example 20 | −8.1 | 0.11 | 0.13 | 16.3 | 89.1 | 1452 | Δ | ◎ | 68 | 69 | ○ | 0.4 |
| Example 21 | −6.0 | 0.15 | 0.13 | 16.5 | 91.9 | 1516 | ○ | ◎ | 73 | 75 | ○ | 0.2 |
| Example 22 | −4.2 | 0.23 | 0.13 | 17.0 | 93.5 | 1590 | ○ | ○ | 78 | 81 | ○ | 0.4 |
| Example 23 | −3.0 | 0.25 | 0.13 | 17.3 | 95.5 | 1652 | ○ | ○ | 83 | 86 | ○ | 0.5 |
| Comparative example 10 | −2.4 | 0.33 | 0.13 | 19.0 | 95.5 | 1815 | × | × | 91 | 97 | × | 7.0 |

Note:
ST: sizing tension
BT: winding tension for forming warp beam (c) Sizing Conditions for an AJL (Air Jet Loom)

Sizer: warping sizer

Number of creels: 1134

Sizing agent: polyvinyl alcohol of 6.0% by weight (pure weight base), acrylate ester type copolyrheric sodium salt of 6.5% by weight (pure weight base), fatty acid ester type oil of 2.0% by weight (apparent weight base), paraxylene type penetrant of 0.2% by weight (apparent weight base) and nonionic type antistatic agent of 0.2% by weight (apparent weight base)

After-wax: PH-400 (manufactured by Gpoh Kagaku K.K.) - - - 1 rpm

Number of picks: 88 ends/2.54 cm

Warp tension: 0.11 cN/dtex

Rotational speed of loom: 500 rpm

COMPARATIVE EXAMPLES 11 AND 12

Polyethylene terephthalate (PET) regular yarn of 56 dtex/24 f was-used as a warp yarn and the same yarn of 84 dtex/24 f was used as a weft yarn. The sizing, beaming and weaving operations were carried out under the same conditions for a WJL as in Example 1.

Results thereof were shown in Table 5.

TABLE 5

| No | S (%) | ST (cN/dtex) | BT (cN/dtex) | Q (cN/dtex) | R (%) | Q × R (% cN/dtex) | running stability | mutual stickiness | hardness of beam after one week | hardness of beam after two weeks | quality of warp | machine stop during weaving (frequency/machine × day) |
|---|---|---|---|---|---|---|---|---|---|---|---|---|
| Comparative example 11 | −2.4 | 0.22 | 0.25 | 95.0 | 55.5 | 5273 | ○ | ◎ | 85 | 85 | ○ | 0.2 |
| Comparative example 12 | −3.0 | — | — | — | — | — | × | — | — | — | — | — |

Note:
ST: sizing tension
BT: winding tension for forming warp beam

CAPABILITY OF EXPLOITATION IN INDUSTRY

Since a warp beam is formed by sizing polytrimethylene terephthalate fiber yarns according to the present invention, it is possible to prevent the mutual stickiness of yarns from occurring in the warp beam, whereby the weavability is extremely excellent to result in a woven fabric having a favorable warp-wise quality.

What is claimed is:

1. A warp beam formed of a plurality of sized polytrimethylene terephthalate fiber yarns wound in a sheet form, characterized in that the hardness of the warp beam is in a range from 65 to 90 degrees.

2. A warp beam as defined by claim 1, characterized in that the warp beam is formed of polytrimethylene terephthalate fiber yarns sized so that a characteristic value Q×R satisfies the following equation:

$$1200 \leqq Q \times R \leqq 1800$$

wherein Q is an initial Young's modulus (represented by cN/dtex) and R is a stretch recovery (%) at 10% elongation of the sized yarn.

3. A method for sizing polytrimethylene, terephthalate fiber yarns characterized in that the yarns are fed from squeeze rolls to dry cylinders, during which a stretch ratio S (%) is controlled between the squeeze rolls and the dry cylinders at a value in a range from −9 to −3% or from −1 to +4%.

4. A beaming method characterized in that sized yarns wound on a sizing beam obtained by the sizing method defined by claim 3 are wound on a warp beam with a tension in a range from 0.09 to 0.22 cN/dtex.

* * * * *